US006047904A

United States Patent [19]

Sugimoto et al.

[11] Patent Number: 6,047,904

[45] Date of Patent: Apr. 11, 2000

[54] FUEL INJECTOR FOR AN INTERNAL COMBUSTION ENGINE

[75] Inventors: Tomojiro Sugimoto; Susumu Kojima, both of Susono; Keiso Takeda, Mishima, all of Japan

[73] Assignee: Toyota Jidosha Kabushiki Kaisha, Toyota, Japan

[21] Appl. No.: 09/265,403

[22] Filed: Mar. 10, 1999

[30] Foreign Application Priority Data

Mar. 19, 1998 [JP] Japan ..... 10-71040

[51] Int. Cl.[7] ..... F02M 61/00

[52] U.S. Cl. ..... 239/533.12; 239/533.2; 239/533.3; 239/596; 239/601

[58] Field of Search ..... 239/533.2, 533.3, 239/533.12, 533.14, 592, 594, 596, 601

[56] References Cited

U.S. PATENT DOCUMENTS

| | | | |
|---|---|---|---|
| 5,109,823 | 5/1992 | Yokoyama et al. | 239/533.12 X |
| 5,109,824 | 5/1992 | Okamoto et al. | 239/533.12 X |
| 5,156,130 | 10/1992 | Soma | 239/533.12 X |

FOREIGN PATENT DOCUMENTS

| | | | |
|---|---|---|---|
| 827772 | 5/1938 | France | 239/533.12 |
| 3-78562 | 4/1991 | Japan . | |
| 9486 | 5/1923 | Netherlands | 239/533.12 |

*Primary Examiner*—Andres Kashnikow
*Assistant Examiner*—Robin O. Evans
*Attorney, Agent, or Firm*—Oliff & Berridge, PLC

[57] ABSTRACT

In a fuel injector for an internal combustion engine having a valve body, an injection hole and a fuel reservoir on the downstream side of a seat portion of the valve body, an opening on the outer side of the injection hole has a width generally larger than a height thereof, the width of the injection hole is gradually narrowed inward so that the fuel is injected at a predetermined angle in the direction of width, the height of the injection hole is nearly uniform in the direction of injecting the fuel within the predetermined angle in the direction of width, a through hole is formed at the center portion of the injection hole in the direction of width, and the through hole is communicated with said fuel reservoir and has a height larger than the height of the injection hole.

5 Claims, 6 Drawing Sheets

FUEL INJECTOR FOR AN INTERNAL COMBUSTION ENGINE

BACKGROUND OF THE INVENTION

1. Field of the Invention

The present invention relates to a fuel injector for an internal combustion engine and, particularly, to a fuel injector for an internal combustion engine having a slit-like injection hole to produce a spray of a flat fan shape.

2. Description of the Related Art

In a fuel injector for supplying fuel to an internal combustion engine, the injection hole is made slit-like to produce a spray of a flat fan shape. Japanese Unexamined Patent Publication No. 3-78562 discloses such a fuel injector for an internal combustion engine. The spray of a flat fan shape formed by the fuel injected from the slit-like injection hole of this fuel injector has a small dispersion in concentration and a greatly increased surface area of the spray compared with that of ordinary conical spray, enabling nearly all of the fuel to come into sufficient contact with the air and, hence, to be quickly atomized and mixed. This makes it possible to supply, to the internal combustion engine, a fuel spray in which the fuel is sufficiently atomized and which has a small dispersion in concentration.

However, the fuel injector has a problem in that it is difficult to regulate the flow rate of the fuel. The flow rate of the fuel generally is decided by a minimum sectional area of the injection hole. The slit-like injection hole for forming a spray of a flat fan shape has the width which is gradually narrowed inward so that the inside portion of the injection hole has the minimum sectional area. Therefore, when a current flow rate is smaller than the desired flow rate, the inside portion of the injection hole must be machined directly to enlarge the sectional area thereof. This is very difficult.

SUMMARY OF THE INVENTION

Therefore, an object of the present invention is to provide a fuel injector with a slit-like injection hole for an internal combustion engine, which can easily realize the desired flow rate of the fuel.

According to the present invention, there is provided a first fuel injector for an internal combustion engine having a valve body, an injection hole and a fuel reservoir on the downstream side of a seat portion of the valve body, wherein an opening on the outer side of the injection hole has a width generally larger than a height thereof, the width of the injection hole is gradually narrowed inward so that the fuel is injected at a predetermined angle in the direction of width, the height of the injection hole is nearly uniform in the direction of injecting the fuel within the predetermined angle in the direction of width, a through hole is formed at the center portion of the injection hole in the direction of width, and the through hole is communicated with the fuel reservoir and has a height larger than the height of the injection hole.

According to the present invention, there is provided a second fuel injector for an internal combustion engine having a valve body, an injection hole and a fuel reservoir on the downstream side of a seat portion of the valve body, wherein an opening on the outer side of the injection hole has a width generally larger than a height thereof, the width of the injection hole is gradually narrowed inward so that the fuel is injected at a predetermined angle in the direction of width, the height of the injection hole is nearly uniform in the direction of injecting the fuel within the predetermined angle in the direction of width, a through hole is formed at both sides of the injection hole in the direction of width, the through holes are communicated with the fuel reservoir and have a height larger than the height of the injection hole, and the injection hole is closed on the upstream side so that the injection hole is not communicated directly with the fuel reservoir.

According to the present invention, there is provided a third fuel injector for an internal combustion engine having a valve body, an injection hole and a fuel reservoir on the downstream side of a seat portion of the valve body, wherein an opening on the outer side of the injection hole has a width generally larger than a height thereof, the width of the injection hole is gradually narrowed inward so that the fuel is injected at a predetermined angle in the direction of width, the height of the injection hole is nearly uniform in the direction of injecting the fuel within the predetermined angle in the direction of width, a through hole is formed at both sides of the injection hole in the direction of width, the through holes are communicated with the fuel reservoir and have a height larger than the height of the injection hole, and the through holes are overlapped each other on the upstream side so that the injection hole is not communicated directly with the fuel reservoir.

According to the present invention, there is provided a fourth fuel injector for an internal combustion engine having a valve body, an injection hole and a fuel reservoir on the downstream side of a seat portion of the valve body, wherein an opening on the outer side of the injection hole has a width generally larger than a height thereof, the width of the injection hole is gradually narrowed inward so that the fuel is injected at a predetermined angle in the direction of width, the height of the injection hole is nearly uniform in the direction of injecting the fuel within the predetermined angle in the direction of width, a through hole is formed at the center portion and both sides of the injection hole in the direction of width, and the through holes are communicated with the fuel reservoir and have a height larger than the height of the injection hole.

The present invention will be more fully understood from the description of preferred embodiments of the invention set forth below, together with the accompanying drawings.

DESCRIPTION OF THE PREFERRED EMBODIMENT

Figure 1:
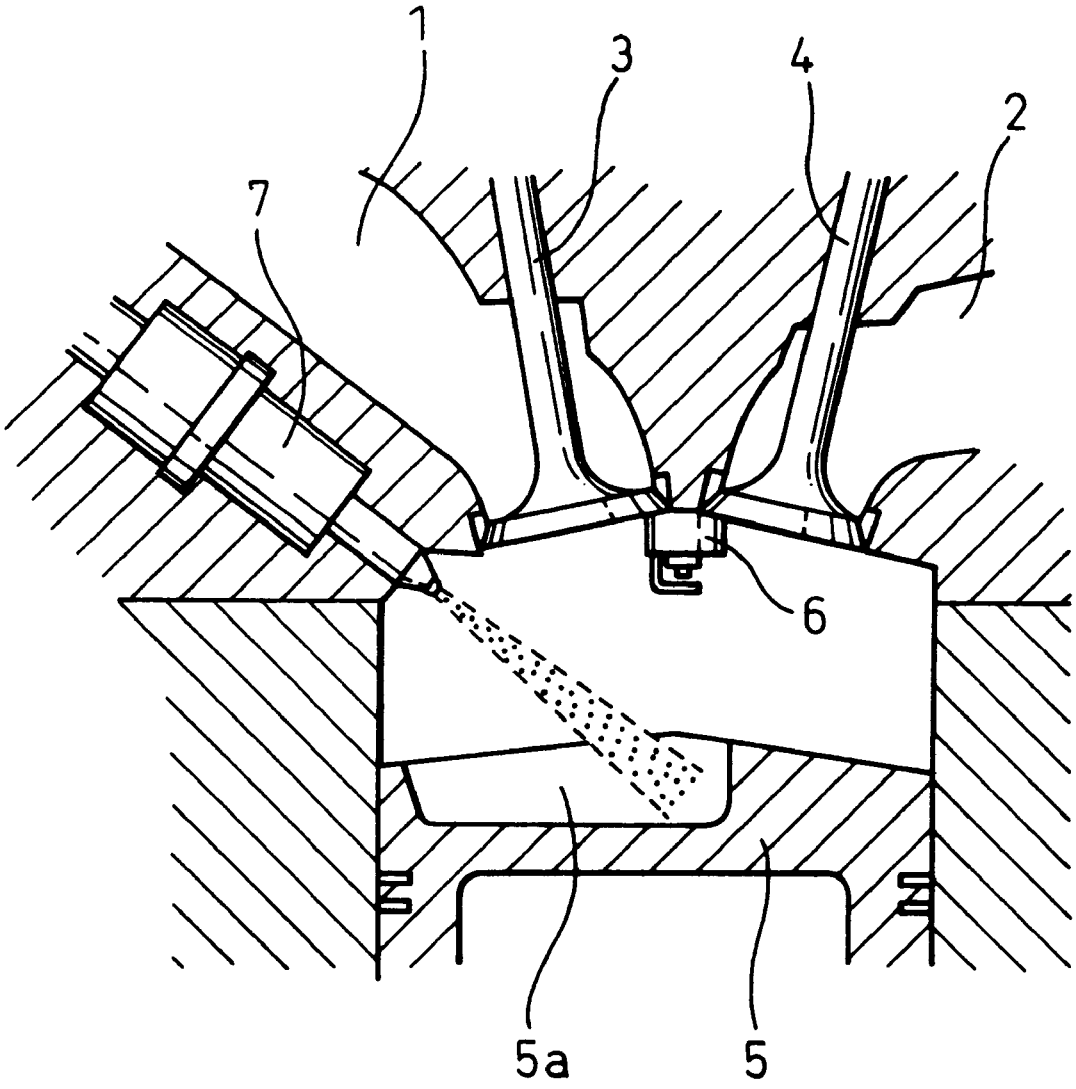
FIG. 1 is a sectional view schematically illustrating a part of direct cylinder injection-type spark-ignition internal combustion engine equipped with a fuel injector according to a first embodiment of the present invention.

FIG. 1 is a sectional view schematically illustrating a part of direct cylinder injection-type spark-ignition internal combustion engine equipped with a fuel injector 7 according to a first embodiment of the present invention. In FIG. 1, reference numeral 1 denotes an intake port and 2 denotes an exhaust port. The intake port 1 is communicated with the cylinder via an intake valve 3, and the exhaust port 2 is communicated with the cylinder via an exhaust valve 4. Reference numeral 5 denotes a piston, and 5*a* denotes the concave combustion chamber arranged on the top surface of the piston 5. The fuel injector 7 directly injects the fuel into the cylinder.

Figure 2:
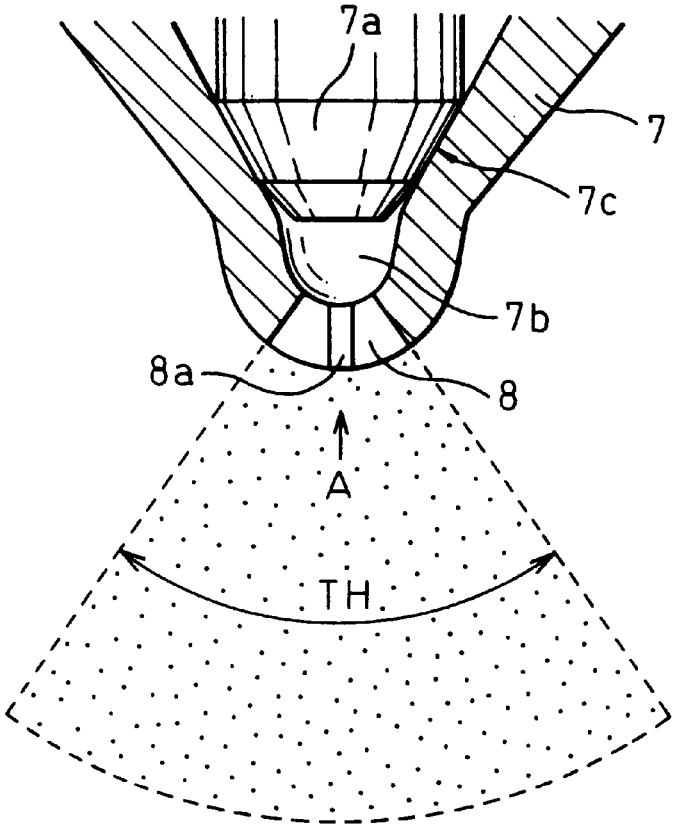
FIG. 2 is an enlarged sectional view illustrating the vicinity of an injection hole of the fuel injector according to the first embodiment.
Figure 3:
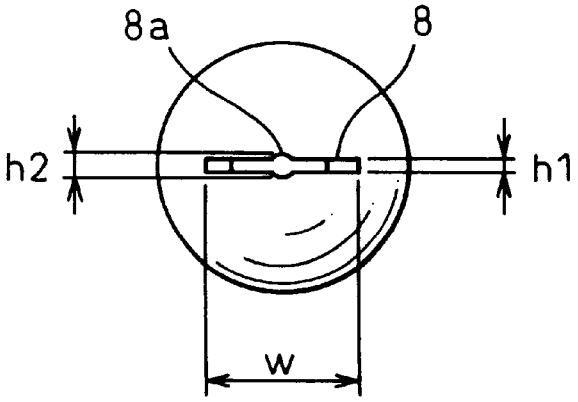
FIG. 3 is an view of part of FIG. 2 viewed from the direction of arrow (A)

FIG. 2 is an enlarged sectional view illustrating the vicinity of an injection hole 8 of the fuel injector 7, and FIG. 3 is an view of part of FIG. 2 viewed from the direction of arrow (A). In these drawings, reference numeral 7*a* denotes an valve body, and 7*b* denotes a fuel reservoir communicated with the injection hole 8, and 7*c* denotes a nozzle seat portion that can be closed by the valve body 7*a*. The high pressure fuel is supplied to the fuel reservoir 7*b* via the nozzle seat portion 7*c* only when the valve body 7*a* is pulled up, whereby the fuel pressure in the fuel reservoir 7*b* is increased, and the fuel is injected from the injection hole 8.

An opening on the outer side of the injection hole 8 at the downstream end in a direction in which the fuel is injected, is flat in cross-section and has the shape of a nearly rectangular slit with a width (w) larger in the flattened direction than a height (h1) thereof. The injection hole 8 has nearly a fan shape of which the width is gradually narrowed inward, i.e., gradually narrowed toward the upstream side in the direction in which the fuel is injected, so that the fuel can be injected at a predetermined angle (TH) in the direction of width. The height of the injection hole 8 is nearly uniform in the direction of the injection of a fan shape at the predetermined angle (TH) in the direction of width. The fuel reservoir 7*b* is of a hemispherical shape having, as a center, the center of the predetermined angle (TH) in the direction of width for injecting the fuel, i.e., a vertex of a fan of the injection hole, whereby the fuel pressure in the fuel reservoir 7*b* equally acts on each portion of the injection hole 8 in the direction of injection.

In the center portion of the injection hole 8 in the direction of width, a through hole 8*a* is formed on the bisector of the predetermined angle (TH) in the direction of width and has a circular cross-section. The diameter (h2) of the through hole 8*a* is larger than the height (h1) of the injection hole 8.

As shown in FIGS. 1 and 2, the fuel injected from the injection hole 8 of the thus constituted fuel injector 7 forms a flat triangular spray having a relatively small thickness corresponding to the height (h1) of the injection hole 7*a*, and whereby nearly all the fuel comes into sufficient contact with the air taken into the cylinder and is favorably atomized. In the present embodiment, the through hole 8*a* is formed in the central portion of the injection hole 8. The diameter (h2) of the through hole 8*a* positioned at the center portion of the injection hole 8 is larger than the height (h1) of the injection hole 8. If a current flow rate is smaller than the desired flow rate in the fuel injector 7, the sectional area of the inside portion of the injection hole 8 must be enlarged. For the purpose, in the present embodiment, the diameter of the through hole 8*a* may be enlarged. The operation can be carried out from the outside of the fuel injector so that it is easy. Thus, it is easy to realize the desired flow rate of the fuel. The through hole 8*a* has a circular section so that to enlarge the size (diameter, i.e., height and width) of the through hole 8*a* can be easy. However, this does not limit the present invention. The through hole may have a rectangular section of which height (h2) is larger than the height (h1) of the injection hole 8.

If the fuel injector 7 is used for the direct cylinder injection-type spark-ignition internal combustion engine shown in FIG. 1, the spray of a predetermined amount of fuel which is sufficiently atomized and has a small dispersion in the concentration, can be supplied into the combustion chamber 5*a* on the top surface of the piston 5 in a compression stroke to accomplish a stratified combustion. Therefore, the stratified combustion takes place more stably. Since the fuel spray has a small thickness, a relatively large amount of fuel can be introduced into the combustion chamber, and the region of stratified combustion can be expanded toward the high-load side.

In the fuel injector 7 of the present embodiment, the through hole 8*a* is formed at the center portion of the injection hole 8. Therefore, the thus-formed fuel spray does not become strictly a flat shape and the thickness thereof at the center portion is larger than that at the other portion. However, since the through hole 8*a* is formed in the central portion of the injection hole 8, the triangular fuel spray is symmetrical. Therefore, in the case that the fuel injector 7 is used for the direct cylinder injection-type spark-ignition internal combustion engine, when fuel is injected during an intake stroke to realize a pre-mixture combustion, the distribution of air-fuel mixture formed in the cylinder in an ignition can be made symmetrical. Therefore, the flame propagation becomes favorable. When fuel is injected during an compression stroke to realize a stratified combustion, the fuel spray is directed to the spark plug directly or via the combustion chamber formed on the top surface of the piston. In an ignition, the center portion of air-fuel mixture formed by the triangular fuel spray contacts with the spark plug, and the center portion of air-fuel mixture is formed by a relatively large amount of fuel, so that the air-fuel mixture is ignited more favorably and thus more reliable ignition can be realized.

Figure 4:
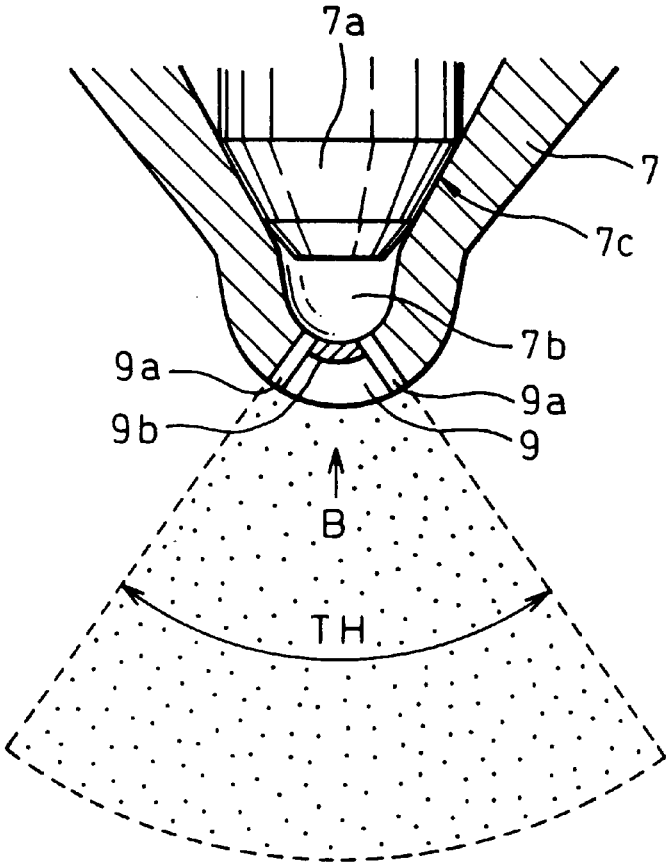
FIG. 4 is an enlarged sectional view illustrating the vicinity of an injection hole of the fuel injector according to a second embodiment.
Figure 5:
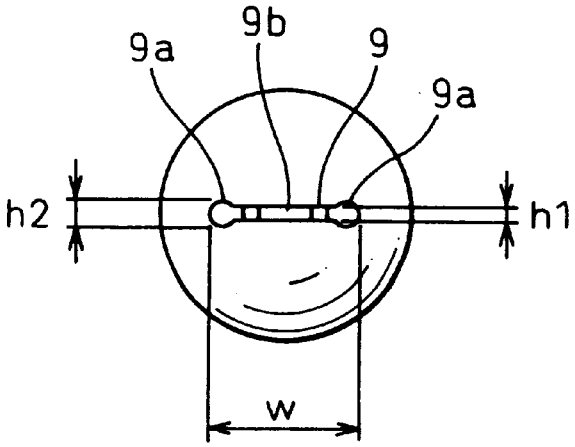
FIG. 5 is an view of part of FIG. 4 viewed from the direction of arrow (B)

FIG. 4 is an enlarged sectional view illustrating the vicinity of an injection hole of the fuel injector according to a second embodiment of the present invention, and FIG. 5 is an view of part of FIG. 4 viewed from the direction of arrow (B). In these drawings, a valve body 7*a*, a fuel reservoir 7*b*, and a nozzle seat portion 7*c* are substantially the same as those of the fuel injector of the first embodiment. Accordingly, explanations of these parts are omitted.

An opening on the outer side of the injection hole 9 of the fuel injector of the present embodiment is also flat in cross-section and has the shape of a nearly rectangular slit with a width (w) larger in the flattened direction than a height (h1) thereof. The injection hole 9 has nearly a fan shape of which the width is gradually narrowed inward, i.e., gradually narrowed toward the upstream side in the direction in which the fuel is injected, so that the fuel can be injected at a predetermined angle (TH) in the direction of width. The height of the injection hole 9 is nearly uniform in the direction of the injection of a fan shape at the predetermined angle (TH) in the direction of width.

In both sides of the injection hole 9 in the direction of width, a through hole 9*a* which has a circular cross-section is formed. The diameter (h2) of the through hole 9*a* is larger than the height (h1) of the injection hole 9. The through holes 9*a* communicate with the fuel reservoir 7*b*. However, the closing portion 9*b* is formed on the upstream side of the injection hole 9 so that the injection hole 9 is closed at the upstream side and does not open directly to the fuel reservoir 7*b*.

In the thus constituted injection hole of the fuel injector 7, at first, the fuel flows into the through holes 9*a* from the fuel reservoir 7*b* and thereafter is spread into the injection hole 9. Therefore, the fuel injected from the injection hole 9 forms a flat triangular spray, and whereby nearly all the fuel comes into sufficient contact with the air taken into the cylinder and is favorably atomized. In the present embodiment, the fuel flows into the injection hole 9 via only the through holes 9*a*. Accordingly, the sectional area by which a flow rate is decided is not the minimum sectional area of the injection hole 9, but is the sectional area of the through holes 9*a*. If a current flow rate is smaller than the desired flow rate in the fuel injector 7, in the present embodiment, the diameter of at least one through hole 9*a* may be enlarged. The operation can be carried out from the outside of the fuel injector so that it is easy. Thus, it is easy to realize the desired flow rate of the fuel. The through holes 9*a* have a circular section so that to enlarge the size (diameter, i.e., height and width) of the through holes 9*a* can be easy. However, this does not limit the present invention. The through holes may have a rectangular section of which height (h2) is larger than the height (h1) of the injection hole 9.

If the fuel injector 7 is used for the direct cylinder injection-type spark-ignition internal combustion engine shown in FIG. 1, the spray of a predetermined amount of fuel which is sufficiently atomized and has a small dispersion in the concentration, can be supplied into the cylinder in a compression stroke to accomplish a stratified combustion. Therefore, the stratified combustion takes place more stably and the region of stratified combustion can be expanded toward the high-load side.

In the fuel injector 7 of the present embodiment, the through hole 9*a* is formed at both sides of the injection hole 9. Therefore, the thus-formed fuel spray does not become strictly a flat shape. However, since the through hole 9*a* which has the height (h2) larger than the height (h1) of the injection hole 9 is formed at both sides of the injection holes, the wall surface resistance decreases at both sides of the injection hole 9 and thus the fuel injected from each portion of the injection hole 9 at nearly a uniform velocity of injection, making it possible to equalize the degree of diffusion. Therefore, the triangular fuel spray has a favorable degree of diffusion even on both sides. Since the through hole 9*a* is formed symmetrically at both sides of the injection hole 9, the triangular fuel spray is symmetrical. Therefore, in the case that the fuel injector 7 is used for the direct cylinder injection-type spark-ignition internal combustion engine, when fuel is injected during an intake stroke to realize a pre-mixture combustion, the distribution of air-fuel mixture formed in the cylinder in an ignition can be made symmetrical. Therefore, the flame propagation becomes favorable.

Figure 6:
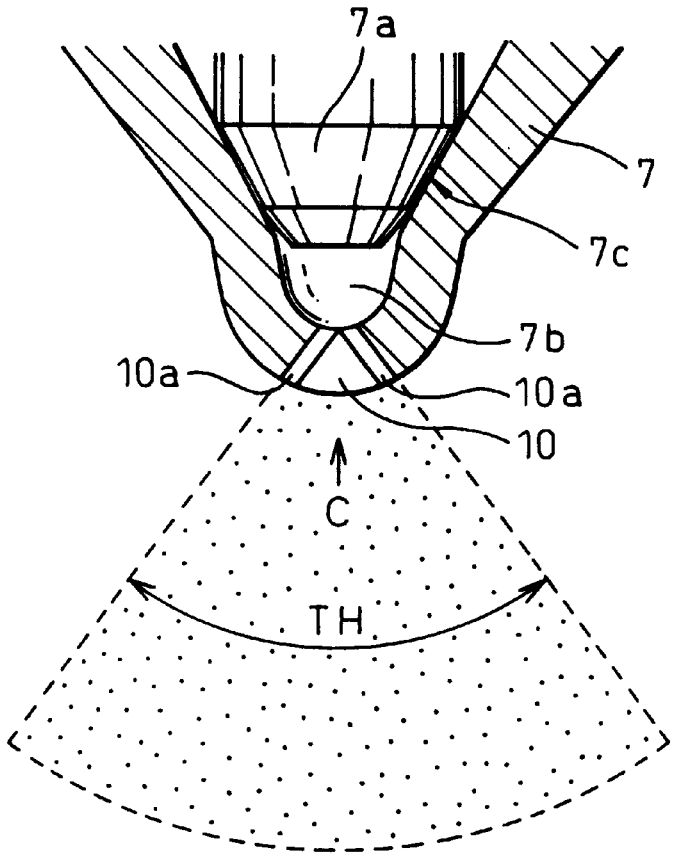
FIG. 6 is an enlarged sectional view illustrating the vicinity of an injection hole of the fuel injector according to a third embodiment.
Figure 7:
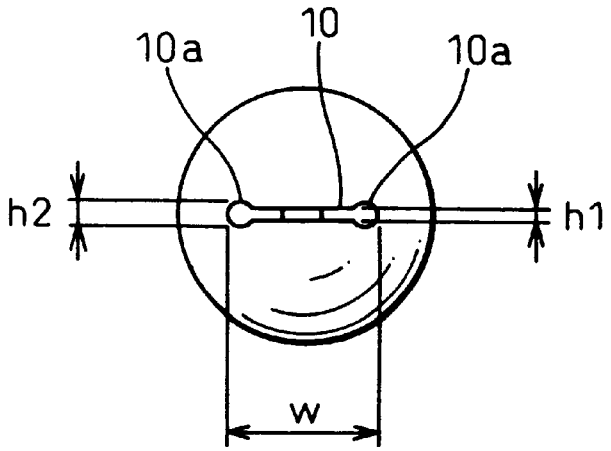
FIG. 7 is an view of part of FIG. 6 viewed from the direction of arrow (C)

FIG. 6 is an enlarged sectional view illustrating the vicinity of an injection hole of the fuel injector according to a third embodiment of the present invention, and FIG. 7 is an view of part of FIG. 6 viewed from the direction of arrow (C). In these drawings, a valve body 7*a*, a fuel reservoir 7*b*, and a nozzle seat portion 7*c* are substantially the same as those of the fuel injector of the above embodiments. Accordingly, explanations of these are omitted.

An opening on the outer side of the injection hole 10 of the fuel injector of the present embodiment is also flat in cross-section and has the shape of a nearly rectangular slit with a width (w) larger in the flattened direction than a height (h1) thereof. The injection hole 10 has nearly a fan shape of which the width is gradually narrowed inward, i.e., gradually narrowed toward the upstream side in the direction in which the fuel is injected, so that the fuel can be injected at a predetermined angle (TH) in the direction of width. The height of the injection hole 10 is nearly uniform in the direction of the injection of a fan shape at the predetermined angle (TH) in the direction of width.

In both sides of the injection hole 10 in the direction of width, a through hole 10*a* which has a circular cross-section is formed. The diameter (h2) of the through hole 10*a* is larger than the height (h1) of the injection hole 10. The through holes 10*a* communicate with the fuel reservoir 7*b*. However, the through holes 10*a* are overlapped each other on the inner side of the injection hole 10 so that the injection hole 10 does not open directly to the fuel reservoir 7*b*.

In the thus constituted injection hole 10 of the fuel injector 7, at first, the fuel flows into the through holes 10*a* from the fuel reservoir 7*b* and thereafter is spread into the injection hole 10. Therefore, the fuel injected from the injection hole 10 forms a flat triangular spray, and whereby nearly all the fuel comes into sufficient contact with the air taken into the cylinder and is favorably atomized. In the present embodiment, the fuel flows into the injection hole 10 via only the through holes 10*a*. Accordingly, the sectional area by which a flow rate is decided is not the minimum sectional area of the injection hole 10, but is the sectional area of the two through holes 10*a*. Thus, the present embodiment has the same effects of the second embodiment. In the second embodiment, the fuel may stagnate in the injection hole 9 by the closing portion 9*b*. However, in the present embodiment, no closing portion is provided so that the fuel does not stagnate in the injection hole 10 and thus the shape of flat triangular fuel spray can be more stable. The through holes 10*a* have a circular section so that to enlarge the size (diameter, i.e., height and width) of the through holes 10*a* can be easy. However, this does not limit the present invention. The through holes may have a rectangular section of which height (h2) is larger than the height (h1) of the injection hole 10.

If the fuel injector 7 is used for the direct cylinder injection-type spark-ignition internal combustion engine shown in FIG. 1, the spray of a predetermined amount of fuel which is sufficiently atomized and has a small dispersion in the concentration, can be supplied into the cylinder in a compression stroke to accomplish a stratified combustion. Therefore, the stratified combustion takes place more stably and the region of stratified combustion can be expanded toward the high-load side.

In also the fuel injector 7 of the present embodiment, the through hole 10*a* is formed at both sides of the injection hole 10. Therefore, the thus-formed fuel spray does not become strictly a flat shape. However, since through hole 10*a* which has the height (h2) larger than the height (h1) of the injection hole 10 is formed at both sides of the injection hole, the wall surface resistance decreases at both sides of the injection hole 10 and thus the fuel injected from each portion of the injection hole 10 at nearly a uniform velocity of injection, making it possible to equalize the degree of diffusion.

Therefore, the triangular fuel spray has a favorable degree of diffusion even on both sides. Since the through hole 10*a* is formed symmetrically at both sides of the injection hole 10, the triangular fuel spray is symmetrical. Therefore, in the case that the fuel injector 7 is used for the direct cylinder injection-type spark-ignition internal combustion engine, the distribution of air-fuel mixture formed in the cylinder in an ignition can be made symmetrical.

Figure 8:
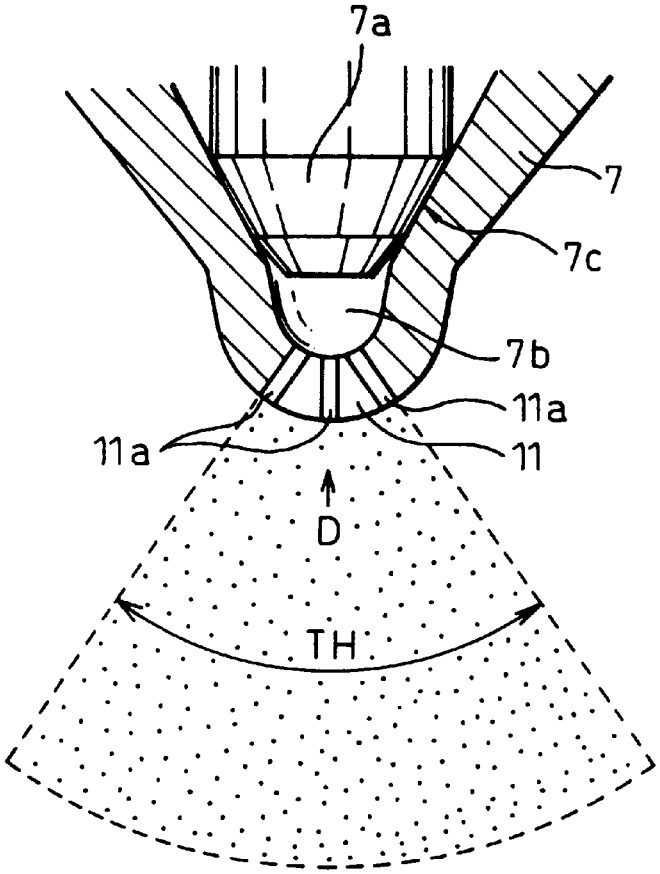
FIG. 8 is an enlarged sectional view illustrating the vicinity of an injection hole of the fuel injector according to a fourth embodiment.
Figure 9:
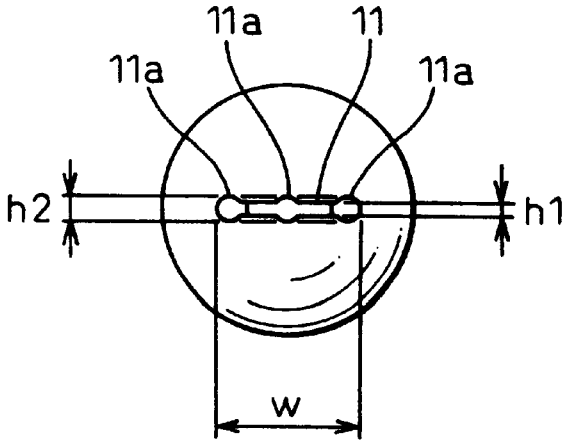
FIG. 9 is an view of part of FIG. 8 viewed from the direction of arrow (D)

FIG. 8 is an enlarged sectional view illustrating the vicinity of an injection hole of the fuel injector according to a fourth embodiment of the present invention, and FIG. 9 is an view of part of FIG. 8 viewed from the direction of arrow (D). In these drawings, a valve body 7*a*, a fuel reservoir 7*b*, and a nozzle seat portion 7*c* are substantially the same as those of the fuel injector of the above embodiments. Accordingly, explanations of these parts are omitted.

An opening on the outer side of the injection hole 11 of the fuel injector of the present embodiment is also flat in cross-section and has the shape of a nearly rectangular slit with a width (w) larger in the flattened direction than a height (h1) thereof. The injection hole 11 has nearly a fan shape of which the width is gradually narrowed inward, i.e., gradually narrowed toward the upstream side in the direction in which the fuel is injected, so that the fuel can be injected at a predetermined angle (TH) in the direction of width. The height of the injection hole 11 is nearly uniform in the direction of the injection of a fan shape at the predetermined angle (TH) in the direction of width.

In each of the center portion and both sides of the injection hole 11 in the direction of width, a through hole 11*a* which has a circular cross-section is formed. The diameter (h2) of the through holes 11*a* is larger than the height (h1) of the injection hole 11.

In the thus constituted injection hole 11 of the fuel injector 7, the fuel injected from the injection hole 11 forms a flat triangular spray and, thereby, nearly all the fuel comes into sufficient contact with the air taken into the cylinder and is favorably atomized. In the present embodiment, the diameter (h2) of the through hole 11*a* positioned at the center portion and both sides of the injection hole 11 is larger than the height (h1) of the injection hole 11. If a current flow rate is smaller than the desired flow rate in the fuel injector 7, the sectional area of the inside portion of the injection hole 11 must be enlarged. For the purpose, in the present embodiment, the diameter of at least one through hole 11*a* may be enlarged. The operation can be carried out from the outside of the fuel injector so that it is easy. Thus, it is easy to realize the desired flow rate of the fuel. The through holes 11*a* have a circular section so that to enlarge the size (height and width) of the through holes 11*a* can be easy. However, this does not limit the present invention. The through hole may have a rectangular section of which the height (h2) is larger than the height (h1) of the injection hole 11.

If the fuel injector 7 is used for the direct cylinder injection-type spark-ignition internal combustion engine shown in FIG. 1, the spray of a predetermined amount of fuel which is sufficiently atomized and has a small dispersion in the concentration, can be supplied into the cylinder in a compression stroke to accomplish a stratified combustion. Therefore, the stratified combustion takes place more stably and the region of stratified combustion can be expanded toward the high-load side.

In also the fuel injector 7 of the present embodiment, the through hole 11*a* is formed at the center portion and both sides of the injection hole 11. Therefore, as the first embodiment, the center portion of air-fuel mixture is formed by a relatively large amount of fuel, so that the air-fuel mixture is ignited more favorably and thus more reliable ignition can be realized. Moreover, as the second and third embodiments, the wall surface resistance decreases at both sides of the injection hole 11 and thus the triangular fuel spray has a favorable degree of diffusion even on both ends. Since the through holes 11*a* are formed symmetrically at the center and both sides of the injection hole 11, the triangular fuel spray is symmetrical. Therefore, in the case that the fuel injector 7 is used for the direct cylinder injection-type spark-ignition internal combustion engine, the distribution of air-fuel mixture formed in the cylinder in an ignition can be made symmetrical.

In the present embodiment, the diameter of the through hole at the center portion of the injection hole is same as that of both sides thereof. However, the diameter of the through hole at the center portion of the injection hole may be different from that of both sides thereof.

Figure 10:
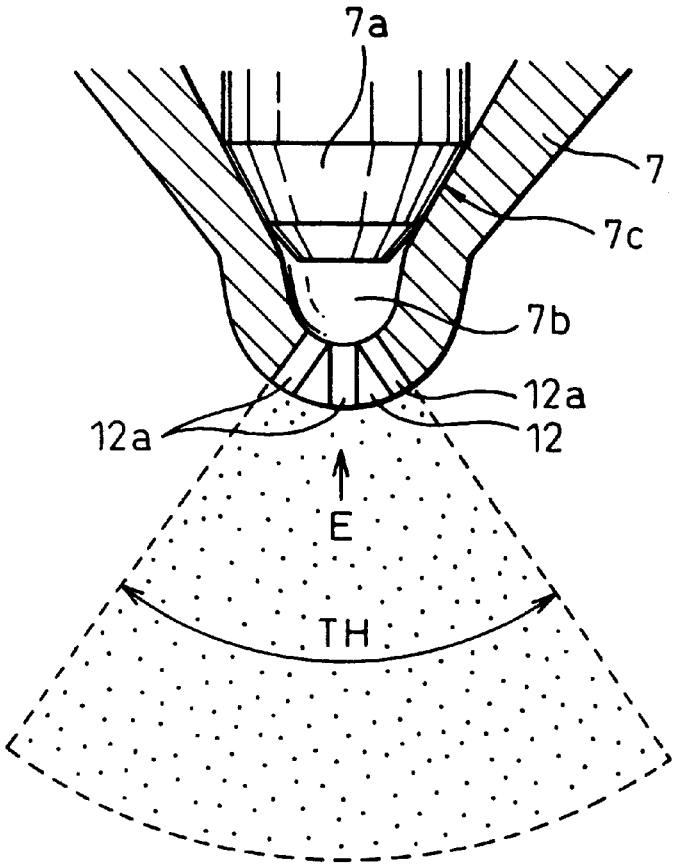
FIG. 10 is an enlarged sectional view illustrating the vicinity of an injection hole of the fuel injector according to a fifth embodiment.
Figure 11:
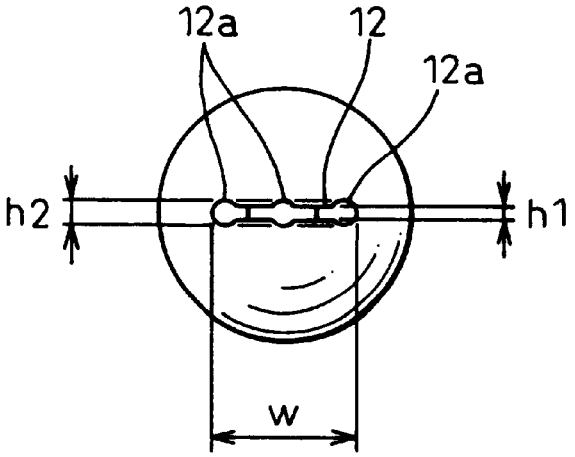
FIG. 11 is an view of part of FIG. 10 viewed from the direction of arrow (E).

FIG. 10 is an enlarged sectional view illustrating the vicinity of an injection hole of the fuel injector according to a fifth embodiment of the present invention, and FIG. 11 is a view of part of FIG. 10 viewed from the direction of arrow (E). Differences between the present embodiment and the fourth embodiment only are explained. An opening on the outer side of the injection hole 12 of the fuel injector of the present embodiment is also flat in cross-section and has the shape of a nearly rectangular slit with a width (w) larger in the flattened direction than a height (h1) thereof. The injection hole 12 has nearly a fan shape of which the width is gradually narrowed inward, i.e., gradually narrowed toward the upstream side in the direction in which the fuel is injected, so that the fuel can be injected at a predetermined angle (TH) in the direction of width. The height of the injection hole 12 is nearly uniform in the direction of the injection of a fan shape at the predetermined angle (TH) in the direction of width.

In each of the center portion and both sides of the injection hole 12 in the direction of width, a through hole 12*a* which has a circular cross-section is formed. The diameter (h2) of the through hole 12*a* is larger than the height (h1) of the injection hole 12.

In the present embodiment, the through holes 12*a* communicate with the fuel reservoir 7*b*. However, the through holes 12*a* overlap one another on the inner side of the injection hole 12 so that the injection hole 12 does not open directly to the fuel reservoir 7*b*.

In the thus constituted injection hole 12 of the fuel injector 7, at first, the fuel flows into the through holes 12*a* from the fuel reservoir 7*b* and thereafter is spread into the injection hole 12. Therefore, the fuel injected from the injection hole 12 forms a flat triangular spray, and whereby nearly all the fuel comes into sufficient contact with the air taken into the cylinder and is favorably atomized. In the present embodiment, the fuel flows into the injection hole 12 via only the through holes 12*a*. Accordingly, the sectional area by which a flow rate is decided is not the minimum sectional area of the injection hole 12, but is the sectional area of the three through holes 12*a*. If a current flow rate is smaller than the desired flow rate in the fuel injector 7, in the present embodiment, the diameter of at least one through hole 12*a* may be enlarged. The operation can be carried out from the outside of the fuel injector so that it is easy. Thus, it is easy to realize the desired flow rate of the fuel. The through holes 12*a* have a circular section so that to enlarge the size (diameter, i.e., height and width) of the through holes 12*a* can be easy. However, this does not limit the present invention. The through holes may have a rectangular section of which height (h2) is larger than the height (h1) of the injection hole 9. In the present embodiment, no closing portion is provided so that the fuel does not stagnate in the injection hole 12 and thus the shape of flat triangular fuel spray can be more stable.

If the fuel injector 7 is used for the direct cylinder injection-type spark-ignition internal combustion engine shown in FIG. 1, the spray of a predetermined amount of fuel which is sufficiently atomized and has a small dispersion in the concentration, can be supplied into the cylinder in a compression stroke to accomplish a stratified combustion. Therefore, the stratified combustion takes place more stably and the region of stratified combustion can be expanded toward the high-load side.

In also the fuel injector 7 of the present embodiment, the through hole 12*a* is formed at the center portion and both sides of the injection hole 12. Therefore, as the first embodiment, the center portion of air-fuel mixture is formed by a relatively large amount of fuel, so that the air-fuel mixture is ignited more favorably and thus more reliable ignition can be realized. Moreover, as the second and third embodiments, the wall surface resistance decreases at both sides of the injection hole 12 and thus the triangular fuel spray has a favorable degree of diffusion even on both sides. Since the through holes 12*a* are formed symmetrically at the center and both sides of the injection hole 12, the triangular fuel spray is symmetrical.

In the present embodiment, the diameter of the through holes at the center portion of the injection hole is same as that of both sides thereof. However, the diameter of the through holes at the center portion of the injection hole may be different from that of both sides thereof.

In each embodiment, the fuel reservoir is made hemispherical. However, as a shape of fuel reservoir, any shape can be selected. If the boundary line between the fuel reservoir and the injection hole is an arc on each transverse plane within the height of the injection hole, the fuel pressure acting on each portion of the injection hole can be nearly uniform.

Although the invention has been described with reference to specific embodiments thereof, it should be apparent that numerous modifications can be made thereto by those skilled in the art, without departing from the basic concept and scope of the invention.

We claim:

1. A fuel injector for an internal combustion engine having a valve body, an injection hole and a fuel reservoir on the downstream side of a seat portion of said valve body, wherein an opening on the outer side of said injection hole has a width generally larger than a height thereof, the width of said injection hole gradually narrows toward the fuel reservoir so that the fuel is injected at a predetermined angle in the direction of width, the height of said injection hole is nearly uniform in the direction of injecting the fuel within said predetermined angle in the direction of width, a through hole is formed at the center portion of said injection hole in the direction of width, and said through hole is communicated with said fuel reservoir and has a height larger than the height of said injection hole.

2. A fuel injector for an internal combustion engine having a valve body, an injection hole and a fuel reservoir on the downstream side of a seat portion of said valve body, wherein an opening on the outer side of said injection hole has a width generally larger than a height thereof, the width of said injection hole gradually narrows toward the fuel reservoir so that the fuel is injected at a predetermined angle in the direction of width, the height of said injection hole is nearly uniform in the direction of injecting the fuel within said predetermined angle in the direction of width, a through hole is formed at both sides of said injection hole in the direction of width, said through holes are communicated with said fuel reservoir and have a height larger than the height of said injection hole, and said injection hole is closed on the upstream side so that said injection hole is not communicated directly with said fuel reservoir.

3. A fuel injector for an internal combustion engine having a valve body, an injection hole and a fuel reservoir on the downstream side of a seat portion of said valve body, wherein an opening on the outer side of said injection hole has a width generally larger than a height thereof, the width of said injection hole gradually narrows toward the fuel reservoir so that the fuel is injected at a predetermined angle in the direction of width, the height of said injection hole is nearly uniform in the direction of injecting the fuel within said predetermined angle in the direction of width, a through hole is formed at both sides of said injection hole in the direction of width, said through holes are communicated with said fuel reservoir and have a height larger than the height of said injection hole, and said through holes are overlapped each other on the upstream side so that said injection hole is not communicated directly with said fuel reservoir.

4. A fuel injector for an internal combustion engine having a valve body, an injection hole and a fuel reservoir on the downstream side of a seat portion of said valve body, wherein an opening on the outer side of said injection hole has a width generally larger than a height thereof, the width of said injection hole gradually narrows toward the fuel reservoir so that the fuel is injected at a predetermined angle in the direction of width, the height of said injection hole is nearly uniform in the direction of injecting the fuel within said predetermined angle in the direction of width, a through hole is formed at the center portion and both sides of said injection hole in the direction of width, and said through holes communicated with said fuel reservoir and have a height larger than the height of said injection hole.

5. A fuel injector according to claim 4, wherein said through holes are overlap one another on the upstream side so that said injection hole is not communicated directly with said fuel reservoir.

* * * * *